US007269862B2

(12) United States Patent
Rooke et al.

(10) Patent No.: US 7,269,862 B2
(45) Date of Patent: Sep. 18, 2007

(54) CONFIGURABLE SHOWER SYSTEM

(75) Inventors: Georgina E. Rooke, London (GB); Cheryl A. Furtak, Birmingham, MI (US); Keith A. Grider, Columbus, OH (US); Mark D. Begin, Worthington, OH (US); Frank J. Wilgus, Ostrander, OH (US)

(73) Assignees: Sculptured Homes, LLC, Birmingham, MI (US); Sculptured Homes Limited, London (GB)

( * ) Notice: Subject to any disclaimer, the term of this patent is extended or adjusted under 35 U.S.C. 154(b) by 322 days.

(21) Appl. No.: 10/935,143

(22) Filed: Sep. 7, 2004
(Under 37 CFR 1.47)

(65) Prior Publication Data

US 2005/0071916 A1 Apr. 7, 2005

Related U.S. Application Data

(60) Provisional application No. 60/501,773, filed on Sep. 10, 2003.

(51) Int. Cl.
*A47K 3/28* (2006.01)

(52) U.S. Cl. ..... 4/613; 4/614

(58) Field of Classification Search ..... 4/524, 4/525, 612–614
See application file for complete search history.

(56) References Cited

U.S. PATENT DOCUMENTS

| | | | | |
|---|---|---|---|---|
| 1,017,167 | A * | 2/1912 | Pleins | 4/613 |
| 3,007,178 | A * | 11/1961 | Murray et al. | 4/525 |
| 3,462,771 | A * | 8/1969 | Moretti | 4/613 |
| 3,551,918 | A * | 1/1971 | Bergmark | 4/613 |
| D238,490 | S | 1/1976 | Blitch | D23/307 |
| D253,672 | S | 12/1979 | Baus | D23/305 |
| 4,189,790 | A | 2/1980 | Masters, III | 4/559 |
| 4,361,915 | A | 12/1982 | Siewert | 4/608 |
| D286,173 | S | 10/1986 | Baus | D23/305 |
| D297,157 | S | 8/1988 | Eder | D23/307 |
| 4,987,619 | A | 1/1991 | Smith | 4/612 |
| D321,755 | S | 11/1991 | Poulson et al. | D23/305 |
| 5,255,399 | A * | 10/1993 | Park | 4/525 |
| D346,015 | S | 4/1994 | Maskell et al. | D23/283 |
| D351,019 | S | 9/1994 | Moore et al. | D23/283 |

(Continued)

FOREIGN PATENT DOCUMENTS

| | | |
|---|---|---|
| DE | 3737313 | 5/1989 |

(Continued)

OTHER PUBLICATIONS

Clarke Products Inc., Grand Prairie Texas: Large Colorfloors® for spacious showers, item SB4234, 1993. D23/283 NPL patent shoe, 1 pg.

(Continued)

*Primary Examiner*—Robert M. Fetsuga
(74) *Attorney, Agent, or Firm*—Honigman Miller Schwartz & Cohn LLP

(57) ABSTRACT

A shower system is provided that includes a configurable enclosure at least partially defining a shower area. The shower system also includes a basin having a first channel sized to receive a lower edge of the enclosure such that the enclosure is configurable with respect to the basin in at least one functional arrangement.

12 Claims, 9 Drawing Sheets

U.S. PATENT DOCUMENTS

| | | | | |
|---|---|---|---|---|
| D380,528 | S | 7/1997 | D'Andrea | D23/283 |
| 5,642,959 | A | 7/1997 | Greferath | 4/614 X |
| D385,019 | S | 10/1997 | Sadler | D23/283 |
| D389,232 | S | 1/1998 | Pangowski | D23/307 |
| D406,328 | S | 3/1999 | Speirs et al. | D23/307 |
| 6,003,169 | A | 12/1999 | Davis, Jr. | 4/613 |
| 6,363,547 | B1 * | 4/2002 | Perry | 4/614 |
| 6,443,164 | B1 | 9/2002 | Parker et al. | 4/525 X |
| 6,675,403 | B2 | 1/2004 | Akhtar et al. | 4/526 |
| 6,698,037 | B2 | 3/2004 | Lippe | 4/612 |
| 2004/0003459 | A1 | 1/2004 | Ferreri et al. | 4/597 |
| 2004/0034922 | A1 | 2/2004 | Grayson | 4/613 |
| 2004/0068789 | A1 | 4/2004 | Pastorelli | 4/596 |

FOREIGN PATENT DOCUMENTS

| | | |
|---|---|---|
| DE | 29608819 | 10/1996 |
| DE | 20020711 | 4/2001 |
| EP | 1155649 | 11/2001 |
| EP | 1212970 | 6/2002 |
| EP | 1329183 | 7/2003 |
| GB | 2122076 | 1/1984 |
| WO | 99/43248 | 9/1999 |

OTHER PUBLICATIONS

Kohler Online Catalog, Purist Wet Surface Lavatory K-2313 (3 pages).

Acorn Engineer Co., Jun. 1, 2002, pate T.SBIS—Terrazzo-Ware Shower Base—Institutional Series SBIS-26-RAB, 2 pgs.

Acorn Engineer Co., Jun. 1, 2002, pate T.SBBOD—Terrazzo-Ware Shower Base—Back Outlet Series SBS-36-BOD-FF, 2 pgs.

* cited by examiner

CONFIGURABLE SHOWER SYSTEM

CROSS-REFERENCE TO RELATED APPLICATIONS

This application claims priority to U.S. provisional application 60/501,773 filed on Sep. 10, 2003, which is incorporated herein by reference in its entirety.

FIELD OF THE INVENTION

The present invention relates to a shower system and more particularly to a configurable shower system.

DESCRIPTION OF THE RELATED ART

Showers or shower areas, if they are integrated into larger rooms such as bathrooms and the like, typically require enclosures to prevent the shower water (wastewater and splashing water) from entering the room around it. In a particular implementation, the shower enclosure is placed in the corner of a room, or in some especially partitioned-off portion of the room, which requires some integration of the shower enclosure into the room itself. While these designs have proven effective for the non-discriminating consumer, many consumers demand a more architecturally or aesthetically appealing enclosure or showering atmosphere. Although many contemporary shower designs incorporate aesthetically pleasing materials, functional hardware and architecture into the showing environment, these shower designs are typically custom enclosures designed by architects or interior designers on a case-by-case basis. Accordingly, there is a need for a modular shower system that provides an aesthetically appealing shower enclosure and is versatile enough to accommodate various environments and consumer tastes.

SUMMARY OF THE INVENTION

A shower system is provided that includes a configurable enclosure at least partially defining a shower area. The shower system also includes a basin having a first channel sized to receive a lower edge of the enclosure such that the enclosure is configurable with respect to the basin in at least one functional arrangement.

In another embodiment of the invention, a shower system is provided that includes a configurable enclosure including two or more panels and a splash panel module including at least one piece of shower hardware. The shower system also includes a basin having a first channel sized to receive a lower edge of the panels and the splash panel module. The panels and splash panel module are configurable with respect to the basin in at least one functional arrangement. An upper frame of the shower system includes a channel sized to fit over an upper edge of the panels and the splash panel module. The shower system also includes a ceiling module supported by the upper frame.

BRIEF DESCRIPTION OF THE DRAWINGS

Embodiments of the invention will now be described, by way of example, with reference to the accompanying drawings, wherein.

DETAILED DESCRIPTION

Figure 1:
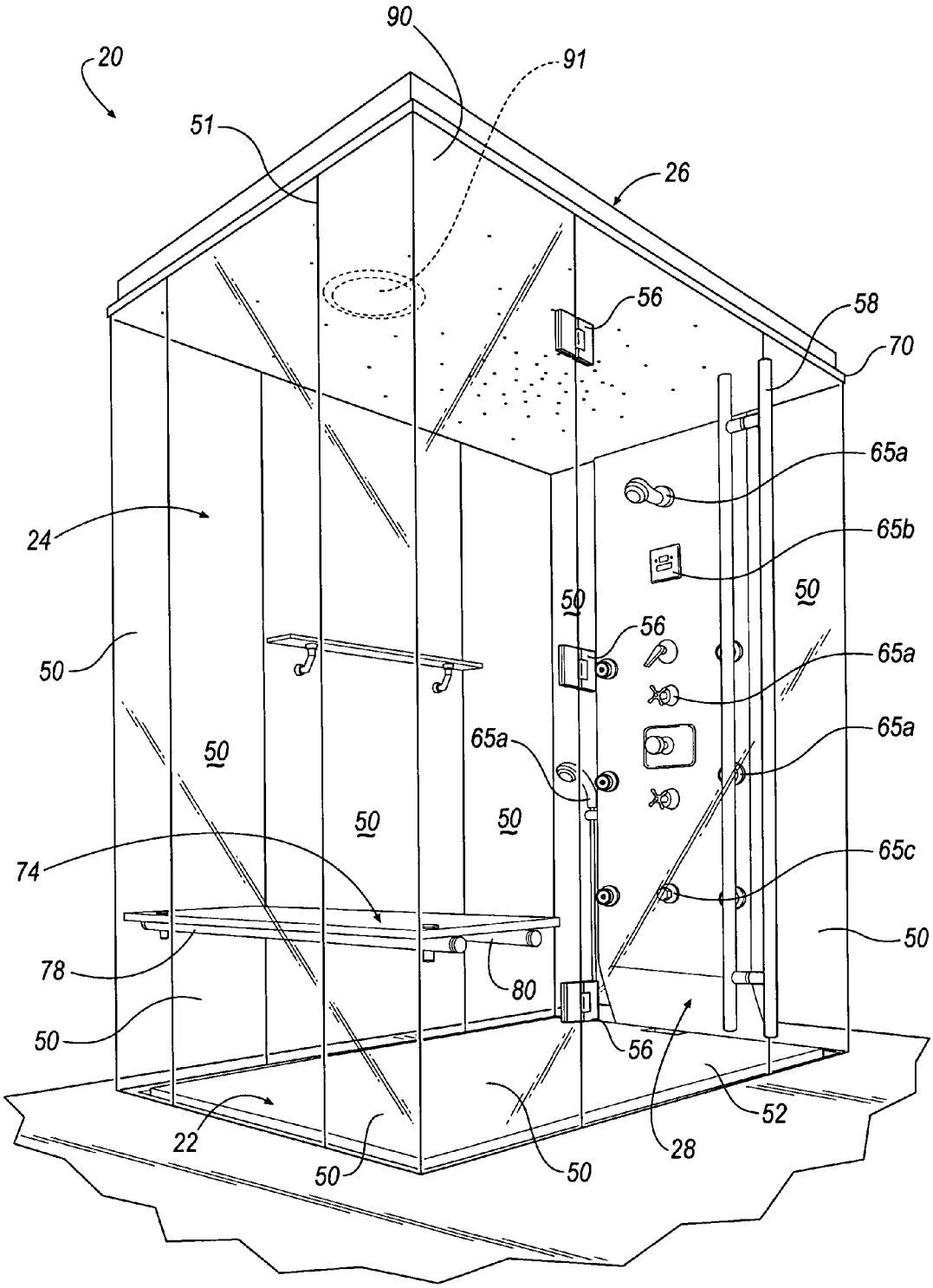
FIG. 1 is a perspective view of a shower system according to an embodiment of the present invention.
Figure 4:
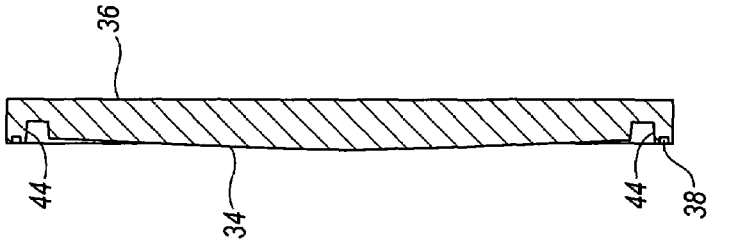
FIG. 4 is a cross-sectional view of the shower-basin of FIG. 2 taken along lines 4-4.

Referring now to the drawings, the preferred illustrative embodiments of the present invention are shown in detail. Although the drawings represent some preferred embodiments of the present invention, the drawings are not necessarily to scale and certain features may be exaggerated to better illustrate and explain the present invention. Further, the embodiments set forth herein are not intended to be exhaustive or otherwise limit or restrict the invention to the precise forms and configurations shown in the drawings and disclosed in the following detailed description.

With reference to FIG. 1, a shower system 20 according to an embodiment of the present invention is shown. In the illustrated embodiment, shower system 20 is depicted as a "stand alone" unit; however, as will be appreciated, a portion of shower system 20 may be integrated into one or more walls of a room or structure.

As shown in FIG. 1, an embodiment of shower system 20 generally includes a basin 22, a configurable enclosure 24, a ceiling module 26 and a splash panel module 28, which may be collectively referred to herein as the "components." These components at least partially define a shower area. As will be discussed in detail below, the modularity of system 20 allows some or all of the components to be arranged in one of several different configurations to accommodate the environment in which system 20 is installed or the particular taste of the user.

Referring to FIGS. 2-7, an embodiment of basin 22 is shown in detail. In the illustrated embodiment, basin 22 includes a generally rectangular body 30 having an outer periphery 32, a top surface 34 and a bottom surface 36. While basin 22 is illustrated as being generally rectangular in shape, it is not necessarily limited thereto.

Figure 2:
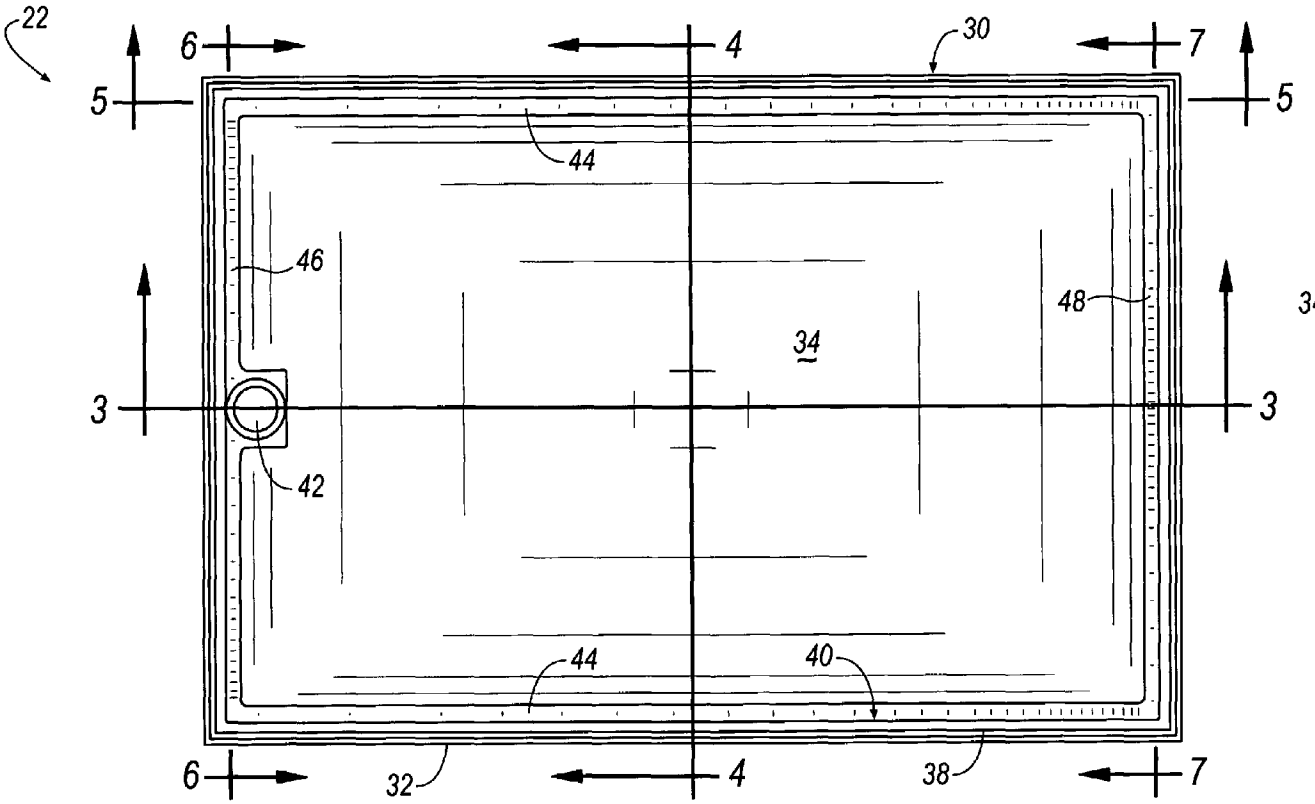
FIG. 2 is a top view of a shower basin according to an embodiment of the present invention.
Figure 3:
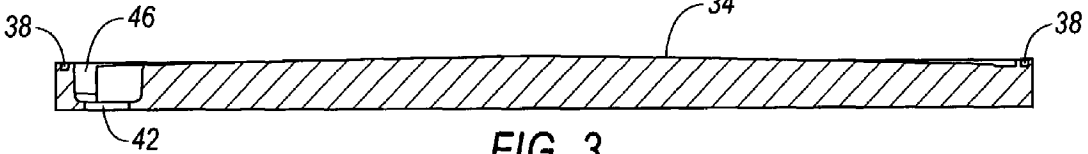
FIG. 3 is a cross-sectional view of the shower basin of FIG. 2 taken along lines 3-3.

Inward of outer periphery 32 is disposed a first channel 38 that extends from top surface 34 and is configured to receive a lower edge of enclosure 24 and optional splash panel module 28. As shown in the embodiment of FIG. 2, first channel 38 boarders the entire outer periphery 32. However, in shower systems that are partially integrated into a wall or other structure, first channel 38 may be positioned around only a portion of basin 22.

Figure 5:
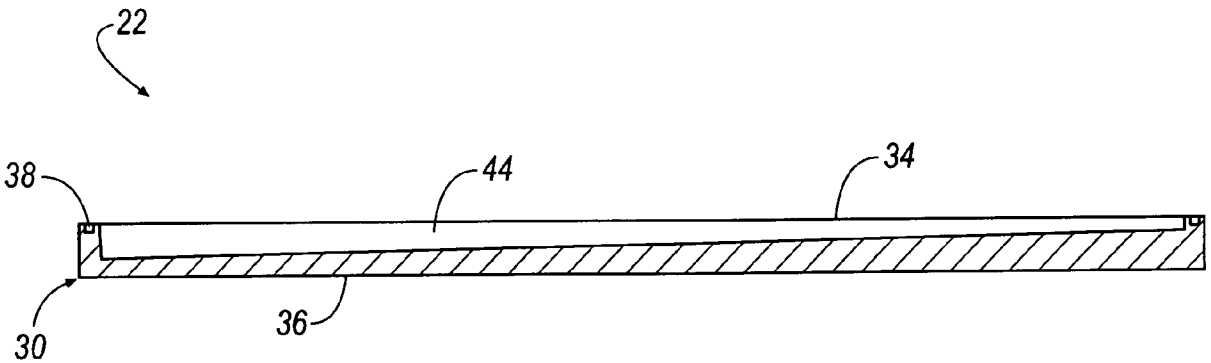
FIG. 5 is a cross-sectional view of the shower basin of FIG. 2 taken along lines 5-5.
Figure 6:
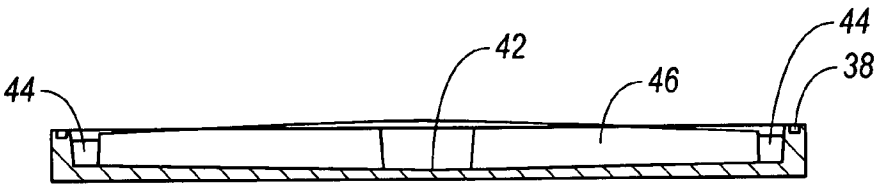
FIG. 6 is a cross-sectional view of the shower basin of FIG. 2 taken along lines 6-6.
Figure 7:
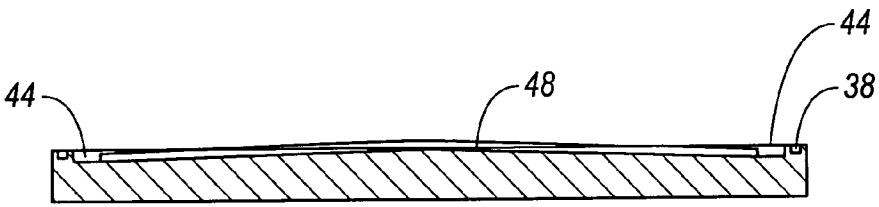
FIG. 7 is a cross-sectional view of the shower basin of FIG. 2 taken along lines 7-7.

Referring still to FIGS. 2-7, basin 22 includes a second channel 40 that also extends from top surface 34. Second channel 40 is configured to collect water run-off from top surface 34 and enclosure 24 and directs the run-off toward a drain 42. In the illustrated embodiment, second channel 40 includes side components 44, a first end component 46 proximate drain 42 and a second end component 48 at an end of basin 22 opposite first end component 46. With reference to FIG. 5, side components 44 of second channel 40 are sloped in a direction toward first end component 46 to direct the collected water toward drain 42. First end component 46 is slightly graded from side components 44 inward, as shown in FIG. 6, to direct the collected water from side components 44 into drain 42. As shown in FIG. 7, second end component 48 is slightly graded from the middle of basin 22 outward to direct the collected water into side components 44 of channel 40. Top surface 34 may be slightly convex or otherwise graded in one or more directions to direct water into second channel 40.

As noted above, system 20 may be installed in a room or structure as a "stand alone" unit or at least partially integrated into the room or structure. Accordingly, basin 22 may be installed such that the portion of top surface 34 adjacent periphery 32 is substantially flush with the floor into which basin 22 is installed, as shown in FIG. 1, or slightly sunken into the floor such that a user must step down into basin 22 upon entry (not shown). Because basin is configured to channel the water around the top surface 34, basin 22 may be relatively thin. This feature permits installation of basin 22 below the surface of a floor without significant intrusion into the sub-floor joists or support structure. Alternatively, basin 22 may be installed in a room or structure such that it is raised above the floor, requiring a user to step up into the basin upon entry.

Among other manufacturing techniques, basin 22 may be made from a molded resin composite. Top surface 34 may be tiled, painted, textured or otherwise decorated to blend with the surrounding floor, or installed "as is" to retain the existing solid surface finish.

In an embodiment of the invention, configurable enclosure 24 includes a number of panels 50 configured to be received in first channel 38 of basin 22. A water-resistant sealing material 51, such as silicone caulking or two-part epoxy, is disposed between each panel 50 when installed in basin 22. In a particular implementation, panels 50 are tempered glass having a thickness slightly less than or equal to the width of first channel 38. First channel 38 and panels 50 may also be sized such that an interference fit is created there between to seal panels 50 within first channel 38. A water-resistant sealing material may also be disposed between basin 22 and panels 50 to create a water tight seal.

Figure 8:
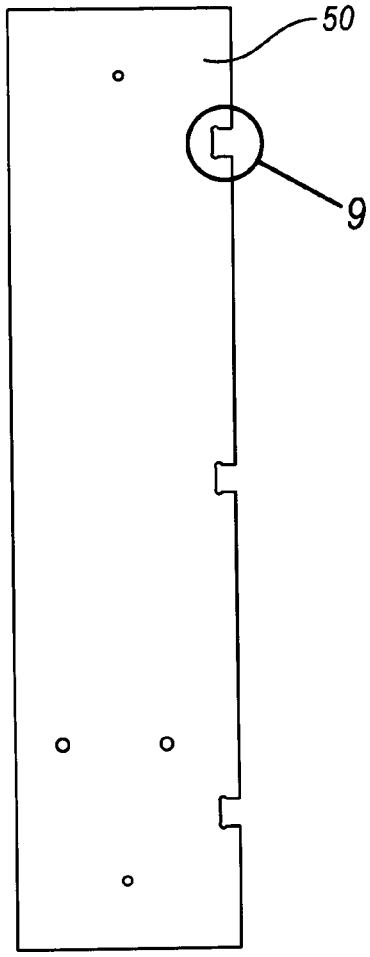
FIG. 8 is an elevation view of a configurable enclosure panel including a hinge slot.
Figure 9:
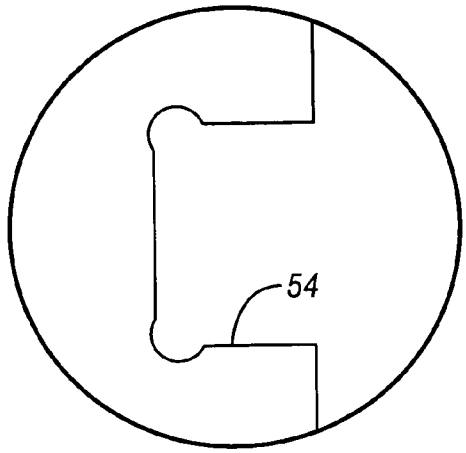
FIG. 9 is a detailed view of a hinge slot shown in FIG. 8.

In an embodiment, configurable enclosure 24 may also be provided with a moveable door panel 52. When so configured, a panel 50 adjacent door panel 52 may include one or more cut-out features 54 for attaching a door hinge 56 (see, e.g., FIGS. 8 and 9). A handle 58 may be attached to the inside and/or outside of door panel 52 to assist a user in moving door panel 52. Optionally, decorative corner panels 60 (see, e.g., FIG. 10) or other decorative trim panel(s) may be attached to corresponding panels 50 by a number of rigid stand-off members 62.

Figure 10:
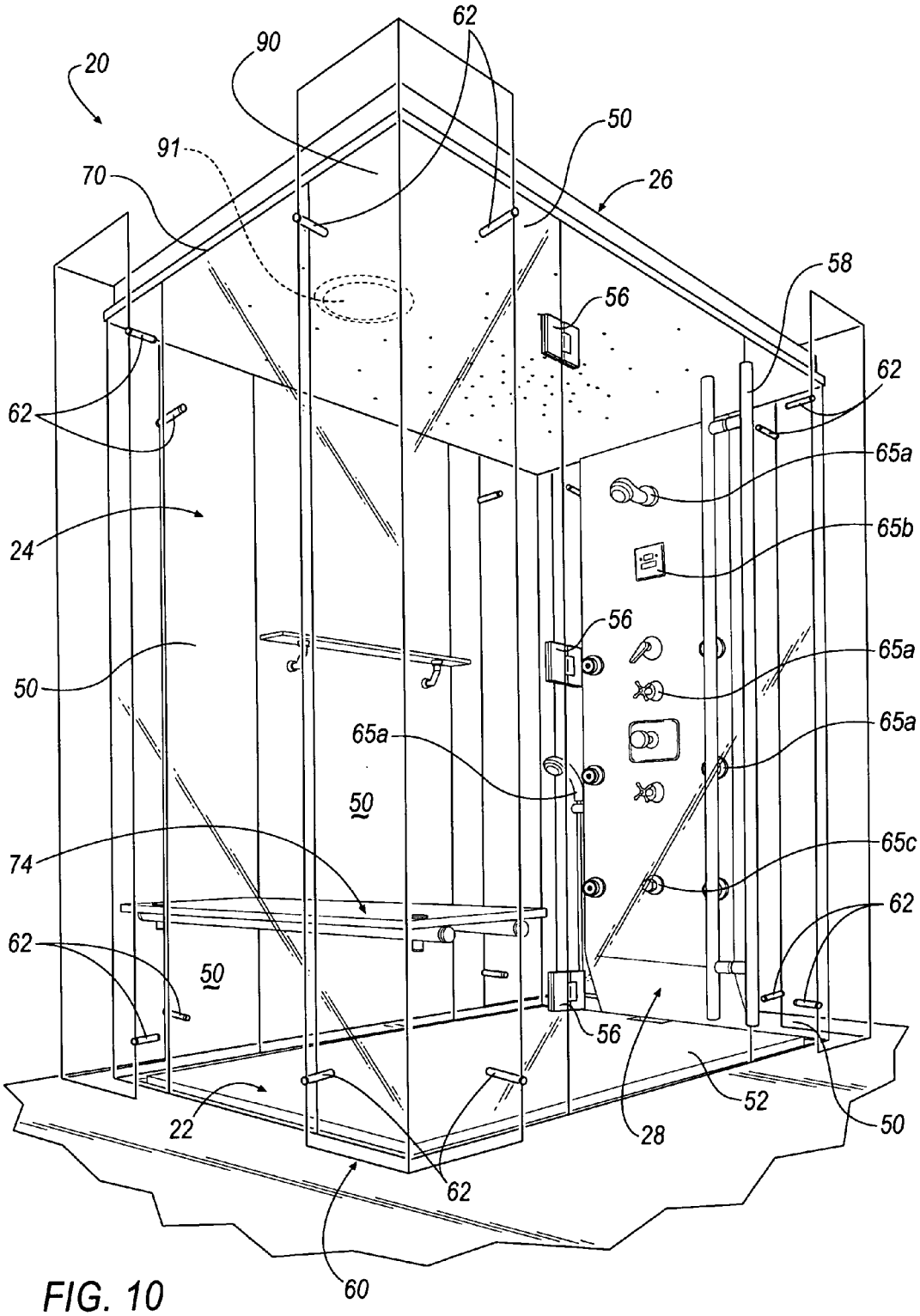
FIG. 10 is a perspective view of a shower system according to another embodiment of the present invention.
Figure 11:
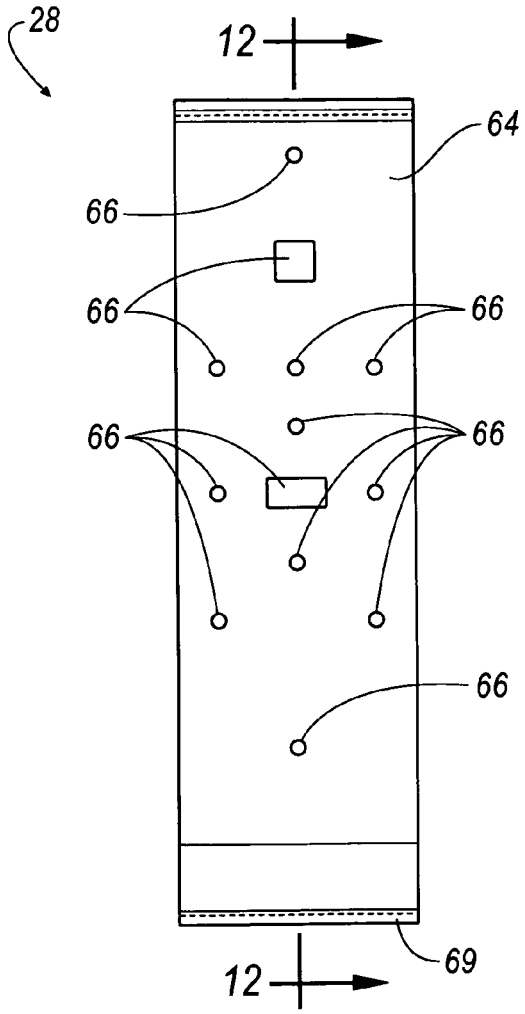
FIG. 11 is a front elevation view of a splash panel module according to an embodiment of the present invention.
Figure 12:
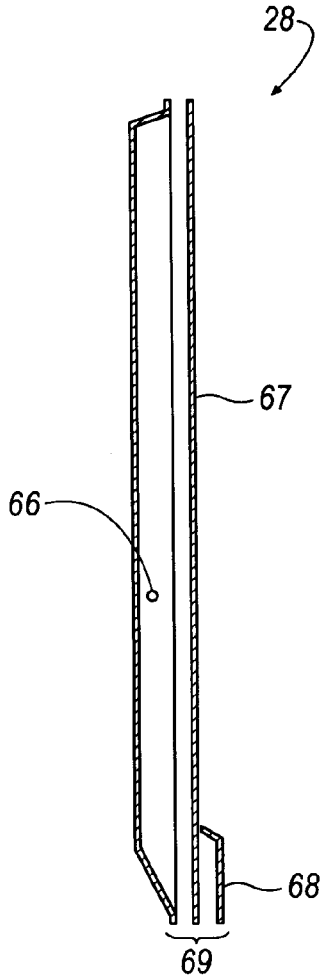
FIG. 12 is a cross-sectional, exploded view of the splash panel module of FIG. 11.

Referring to FIGS. 11 and 12, an embodiment of splash panel module 28 is shown. Splash panel module 28 includes a housing 64 and holes 66 for water distribution hardware. In an embodiment, splash panel module 28 houses the plumbing and fixtures for the water distribution hardware. The fixtures (shown generically in FIGS. 1 and 10 as elements 65A) may include, for example, body jets, head and hand shower units and accompanying water regulation hardware (see, e.g., FIG. 1). Fixtures for distribution of steam (65B) and aromatherapy materials (65C) may also be incorporated into module 28. The term "shower system," as used herein, includes arrangements of some or all of the shower system components to provide, among other things: (i) water distribution alone; (ii) water, steam and/or aromatherapy distribution; or (iii) steam and/or aromatherapy distribution alone.

When installed as a "stand alone" shower system, splash panel module 28 may include a back cover plate 67 (FIG. 12) that conceals the plumbing for the water distribution hardware. When so configured, one or more water pipes are all that protrude from module 28 to allow a plumber to easily install the module to water supply lines. The exposed water pipes may be covered by a pipe cover 68 (FIG. 12) styled to match the décor of splash panel module 28.

Figure 13:
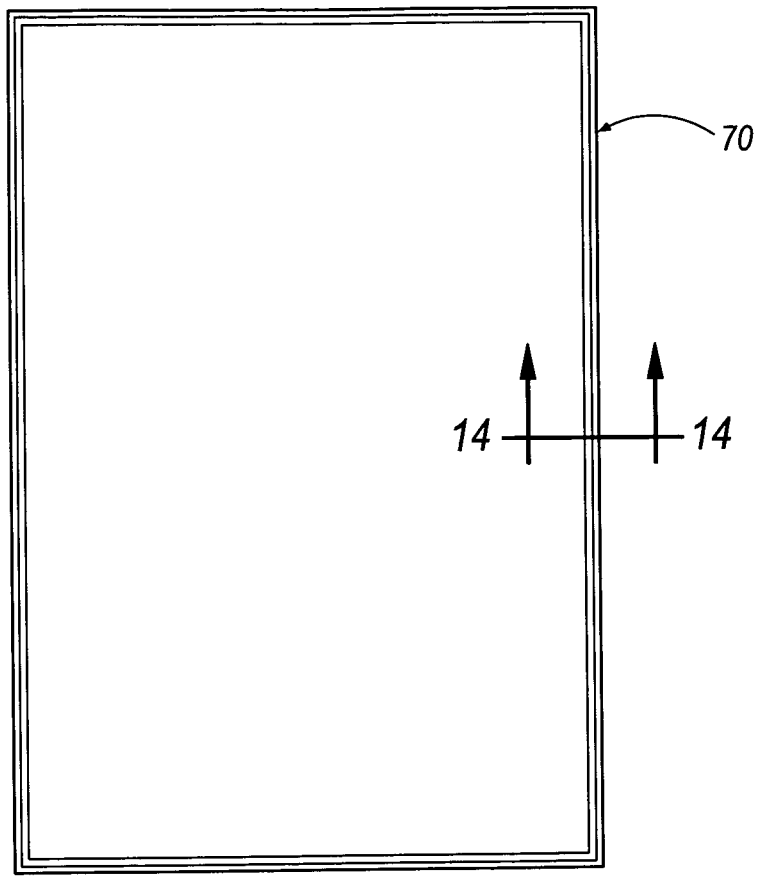
FIG. 13 is a top view of a frame member according to an embodiment of the present invention for use in securing the top portion of the configurable enclosure.
Figure 14:
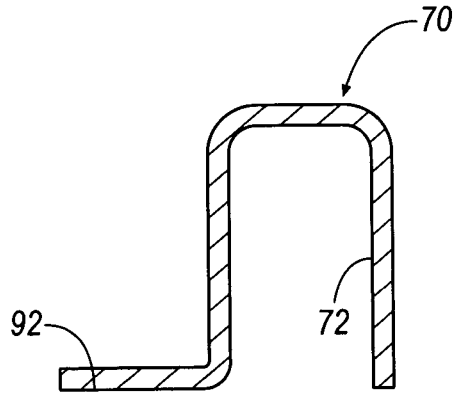
FIG. 14 is a cross-sectional view of the frame member of FIG. 13.

The lower edge of splash panel module 28 is configured to be received in first channel 38 of basin 22. For example, housing 64 incorporates a lip 69 sized for receipt in first channel 38. A sealing material, such as silicone caulking, may be disposed between splash panel module 28 and adjacent panels 50 when installed in basin 22. An upper frame 70 is placed over an upper edge of panels 50 and module 28. As shown in FIGS. 13 and 14, upper frame 70 is generally U-shaped in cross-section having an inner channel 72 sized to receive an upper edge of panels 50 and module 28.

Figure 15:
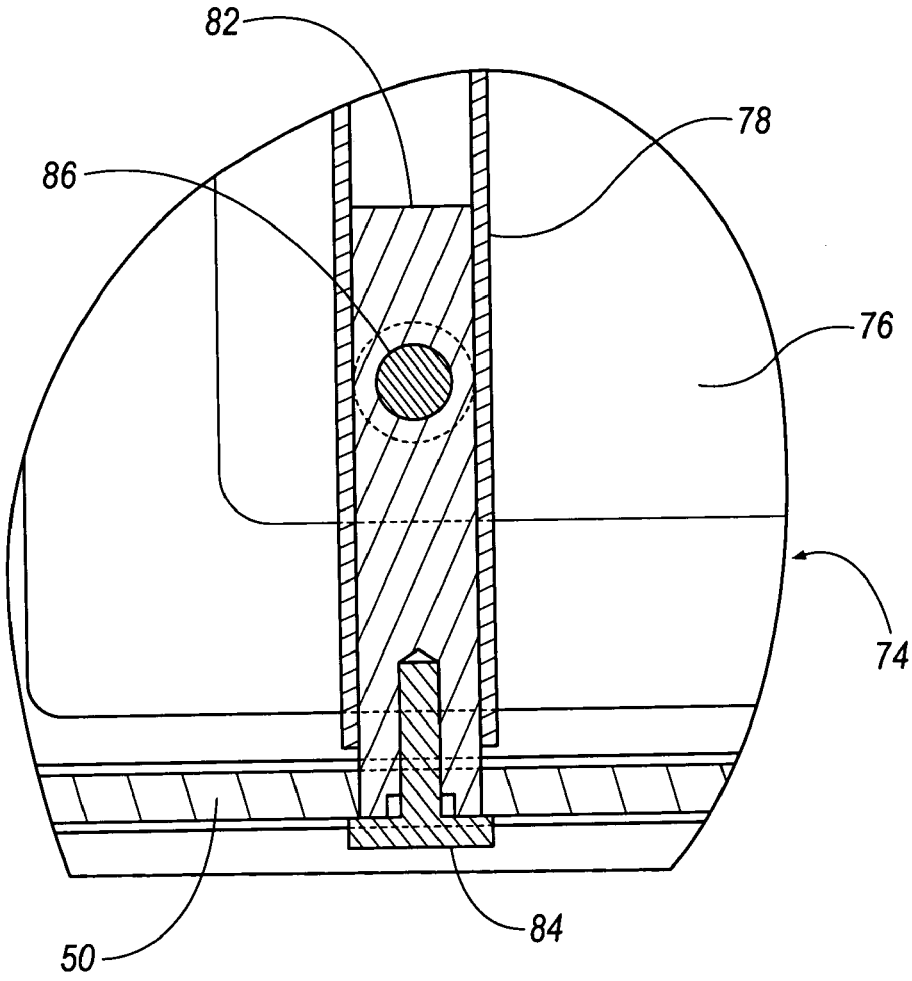
FIG. 15 is a detailed cross-sectional view of a shower seat mount for attaching the shower seat shown in FIGS. 1 and 10 to the configurable enclosure.

Referring to FIGS. 1, 10 and 15, a seat 74 for use in shower system 20 is shown. In the illustrated embodiment, seat 74 includes a seat member 76 that is moveably supported by a pair of support members 78, 80. A first support member 78 is attached to seat member 76 and is rotatable relative to panels 50 between which first support member 78 is supported. In a particular configuration, first support member 78 is a tubular member that includes a generally cylindrical hinge pin 82 inserted in each end thereof. Hinge pins 82 extend into a hole in panels 50 and are secured to panels 50 by a cap 84. Seat member 76 is attached to first support member 78 by a bolt 86 that extends through seat member 76, first support member 78 and hinge pin 82. Hinge pins 82, first support member 78 and seat member 76 are therefore rotatable about an axis that extends through first support member 78 and hinge pins 82. Second support member 80 is fixedly secured to panels 50 and functions to help support the weight of seat member 76 when seat member is rotated downward to a generally horizontal position. In addition to the embodiment shown in FIGS. 1 and 10, it will also be appreciated that seat 74 may be non-movably secured in configurable enclosure 24.

Figure 16:
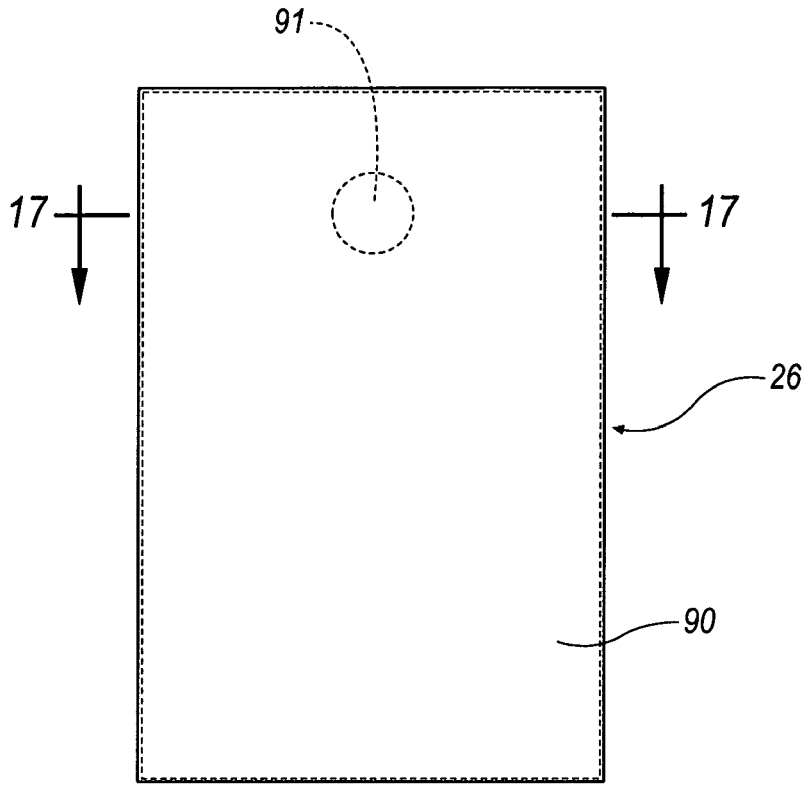
FIG. 16 is a top view of a ceiling module according to an embodiment of the present invention.
Figure 17:
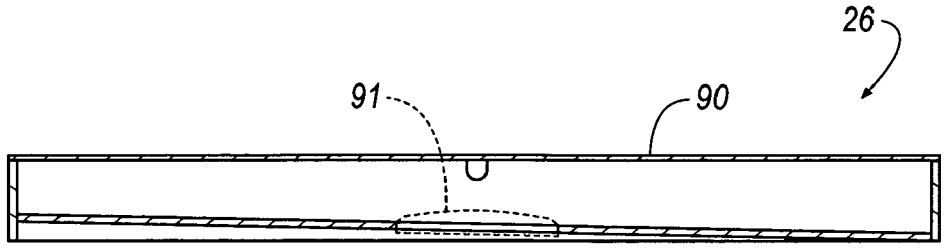
FIG. 17 is a cross-sectional view of the ceiling module of FIG. 16.

Referring to FIGS. 16 and 17, an embodiment of ceiling module 26 is shown. In the illustrated embodiment, ceiling module 26 includes a housing 90 that is supported over configurable enclosure 24 by a flange 92 on upper frame 70 (see FIG. 14). Housing 90 may be made of a lightweight, moisture resistant material, such as acrylic or other suitable plastics. When shower system 20 is provided with steam generating capability, the interior surface of ceiling module 26 may have a slight grade in one or more directions to roll off water for drainage (see, e.g., FIG. 17).

Optionally, housing 90 may be configured to include one or more audio and/or visual components. For example, housing can be configured to include a speaker or speaker system 91 for supplying music and other sounds to the interior of enclosure 24. In another example, housing may be configured to include one or more light producing devices, such as a lamp, LED or fiber optic display. Any electrical wiring needed to power the audio and/or visual components in ceiling module 26 may be routed out of ceiling module 26 through a sleeve or flexible conduit into splash panel module 28 and then out to the power and/or communication source. One or more communication interface devices, such as a wire harness or electrical connector, may be employed between ceiling module 26 and splash panel module 28 to facilitate installation of shower system 20.

As will be appreciated, the modularity of shower system 20 makes it readily configurable to accommodate various environments and tastes. More particularly, the design of basin 22 allows shower system 20 to be installed flush with a floor for a substantially smooth transition between the top surface 34 of basin 22 and the surrounding floor, below the floor surface, or above the floor surface without significant modification to conventional sub-floor structures. Furthermore, the manner in which panels 50 and splash panel module 28 are connected with basin 22 allow panels 50 and module 28 to be arranged in different configurations. For example, with reference to FIG. 1, door panel 52 could easily be installed on the opposite side of system 20 by simply rearranging two or more panels 50 and door panel 52. In a similar example, splash panel module 28 could be installed on an end of basin 22 opposite drain 42.

As will also be appreciated, splash panel module 28 and ceiling module 26 may be manufactured with customized hardware configurations, or may be offered with standard hardware packages. Accordingly, the audio/visual and water distribution hardware requirements of a particular shower system 20 can be accommodated by merely substituting different splash panel module 28 and ceiling module 26 configurations without modifying the remaining components in system 20, i.e., basin 22 and configurable enclosure 24.

The present invention has been particularly shown and described with reference to the foregoing embodiments, which are merely illustrative of the best modes for carrying out the invention. It should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

What is claimed is:

1. A shower system comprising:

a configurable enclosure including two or more panels at least partially defining a shower area; and a basin having a first channel sized to receive a lower edge of the two or more panels such that the panels are configurable with respect to the basin in two or more functional arrangements, a ceiling module, a frame for supporting the ceiling module over the configurable enclosure, wherein the frame includes a channel sized to receive an upper edge of the configurable enclosure and a flange adapted to support the ceiling module over the configurable enclosure.

2. The shower system of claim 1 further including a seat supported by the configurable enclosure.

3. The shower system of claim 1, wherein the configurable enclosure fully defines the shower area.

4. The shower system of claim 1, wherein the shower basin includes a second channel configured to collect water run-off from the configurable enclosure and a top surface of the basin.

5. The shower system of claim 4, wherein the second channel includes a pair of side components and a first end component proximate a drain, the side components being sloped in a direction toward the first end component to direct the collected water toward the drain.

6. The shower system of claim 5, wherein the first end component is slightly graded from the side components inward to direct the collected water from the side components into the drain.

7. The shower system of claim 5, wherein the second channel also includes a second end component at an end of the basin opposite the first end component, and wherein the second end component is slightly graded from a middle of the basin outward to direct the collected water into the side components of the second channel.

8. The shower system of claim 4, wherein the top surface may be slightly convex or graded in one or more directions to direct water into the second channel.

9. The shower system of claim 1, wherein the ceiling module includes at least one audio or visual component.

10. The shower system of claim 1, wherein the two or more panels further include a splash panel module including at least one piece of shower hardware.

11. The shower system of claim 10, wherein a water-resistant sealing material is disposed between each of the panels and between the panels and the splash panel module.

12. The shower system of claim 1, wherein a water-resistant sealing material is disposed between the basin and the configurable enclosure.

* * * * *